US006346052B1

(12) United States Patent
Chappell

(10) Patent No.: US 6,346,052 B1
(45) Date of Patent: Feb. 12, 2002

(54) GOLF CLUB IRONS WITH MULTILAYER CONSTRUCTION

(75) Inventor: Chris Chappell, Westminster, SC (US)

(73) Assignee: Dunlop Slazenger Group Americas, Westminster, SC (US)

( * ) Notice: Subject to any disclaimer, the term of this patent is extended or adjusted under 35 U.S.C. 154(b) by 0 days.

(21) Appl. No.: 09/530,919

(22) PCT Filed: Aug. 18, 1999

(86) PCT No.: PCT/US99/18863

§ 371 Date: May 5, 2000

§ 102(e) Date: May 5, 2000

(87) PCT Pub. No.: WO00/10652

PCT Pub. Date: Mar. 2, 2000

Related U.S. Application Data

(60) Provisional application No. 60/097,459, filed on Aug. 21, 1998.

(51) Int. Cl.[7] ..... A63B 53/04

(52) U.S. Cl. ..... 473/324; 473/349; 473/409; 29/527.6; 205/67

(58) Field of Search ..... 473/324, 330, 473/332, 333, 347, 348, 349, 350, 290, 291, 131, 409; 29/527.5, 527.6; 148/409, 410, 675, 676, 677; 205/67

(56) References Cited

U.S. PATENT DOCUMENTS

| | | | |
|---|---|---|---|
| 5,104,457 | A | 4/1992 | Viljoen et al. |
| 5,207,427 | A | 5/1993 | Saeki |
| 5,458,334 | A | 10/1995 | Sheldon et al. |
| 5,531,444 | A | 7/1996 | Buettner |
| 5,569,337 | A | 10/1996 | Yoshida et al. |
| 5,603,667 | A | 2/1997 | Ezaki et al. |

*Primary Examiner*—Sebastiano Passaniti
(74) *Attorney, Agent, or Firm*—Lorusso & Loud

(57) ABSTRACT

The disclosed invention comprises a novel golf club head and method of manufacturing the golf club head. The golf club head comprises a multilayer construction having a soft nickel alloy core and a hard chrome coating. The process used to produce the golf club heads involves an investment casting process in which the soft nickel alloy core is cast and the hard chrome coating is plated to the core. This multilayer design produces a golf club iron that is durable and consistent from iron to iron with feel characteristics which are generally equal to or better than traditional clubs formed from forged mild carbon steel.

26 Claims, 4 Drawing Sheets

GOLF CLUB IRONS WITH MULTILAYER CONSTRUCTION

CROSS-REFERENCE TO RELATED APPLICATION

A claim of benefit is made to U.S. Provisional Application Ser. No. 60/097,459 filed Aug. 21, 1998, the contents of which are incorporated herein by reference.

FIELD OF THE INVENTION

The present invention relates, in general, to golf club heads, and in particular, to a golf club iron that can be part of a golf club set in which each iron has an inner soft core and a hard outer coating.

BACKGROUND OF THE INVENTION

Prior art golf club heads are typically composed of a number of layers. A core of forged mild carbon steel is used in conjunction with a decorative nickel coating followed by a decorative layer of bright chrome. Depending on the bonding capabilities of the nickel layer, a copper strike layer or plating is first applied to the carbon steel core to improve adhesion of the nickel layer.

The decorative chrome used on prior art golf clubs has a hardness of about 35 to 45 on the Rockwell C scale. The typical thickness of the decorative chrome layer is usually between 0.00005 inches to 0.0002 inches. Thus, a prior art golf club head, as shown in FIG. 1, consists of an inner core 9 of forged mild carbon steel and an outer coating 7 of decorative nickel and decorative chrome. Forging produces a club with acceptable feel characteristics to a golfer at a reasonable cost.

Forging, in general terms, is the process by which metal is shaped by hammering or cogging. While most malleable metals may be shaped in the cold state, the application of heat permits a greater deformation with any given expenditure of energy. Great care must be taken with any forging process due to the high oxidation rate of the metal when it is heated for too long a time period. This over-exposure to elevated temperatures inherently weakens the metal. It also results in a less than desirable surface, characterized by a lack of smoothness. Although forging has been used to construct golf clubs, this method of constructing golf clubs has several faults.

The process itself lacks consistency due to inherent characteristics of the forging process. The clubs lack durability due to the softer and weaker decorative nickel and decorative chrome. Furthermore, because forged mild carbon steel has a tendency to rust, any damage to the integrity of the decorative nickel or decorative chrome coating will inevitably lead to the inside of the club being weakened as well. During the finishing process, inconsistencies can occur due to many manual operations, such as grinding, shaping, milling and polishing. Heads can become warped during the stamping operation due to excessive pressure and incorrect fitting of nest dies.

There is, therefore, a need in the art for golf club irons which possess the acceptable feel characteristics of forged mild carbon steel clubs, but which are more durable and which possess characteristics which are consistent from club to club or iron to iron.

OBJECTS OF THE INVENTION

An object of the present invention is to provide an improved golf club iron, specifically a golf club iron with a head that has greater consistency from club to club than is the case with conventional forged steel golf club irons.

Another object of the present invention is to provide a golf club iron with an outstanding soft feel, but without a tendency to rust, as would be caused by forging iron clubs from conventional mild carbon steel.

Yet another object of the present invention is to provide a golf club iron that is more durable than prior art club irons.

These and other objects of the present invention will become apparent from a review of the description provided below.

SUMMARY OF THE INVENTION

The present invention is an iron or a set of golf club irons and the method of manufacturing such golf club irons. The golf club iron heads comprise a multilayer construction having a soft nickel alloy core and a hard chrome coating. The process of the present invention involves an investment casting process in which the soft nickel alloy core is cast and the hard chrome coating is plated to the core. This multilayer design produces a golf club iron that is durable and consistent from club to club or iron to iron with feel characteristics which are generally equal to or better than traditional clubs formed from forged mild carbon steel.

The above and other features of the invention, including various novel details of construction and combination of materials, will now be more particularly described with reference to the accompanying drawing.

DETAILED DESCRIPTION OF THE PREFERRED EMBODIMENTS

At the outset, the invention is described in its broadest overall aspects with a more detailed description following. The golf club iron, according to the present invention, is manufactured by the investment casting of a soft nickel alloy and subsequently plating the cast nickel alloy core 9' with a hard chrome coating 7'. The term "soft nickel alloy" shall mean a nickel content of from about 1% to about 30% with a hardness rating of from about 70 to about 100 on the Rockwell B scale ("HRB"). It is well known in the art that the higher the nickel content, the softer the alloy and resulting golf club. The term "hard chrome" as used herein shall mean a hardness on the Rockwell C scale of 50–100 ("HRC").

Figure 4:
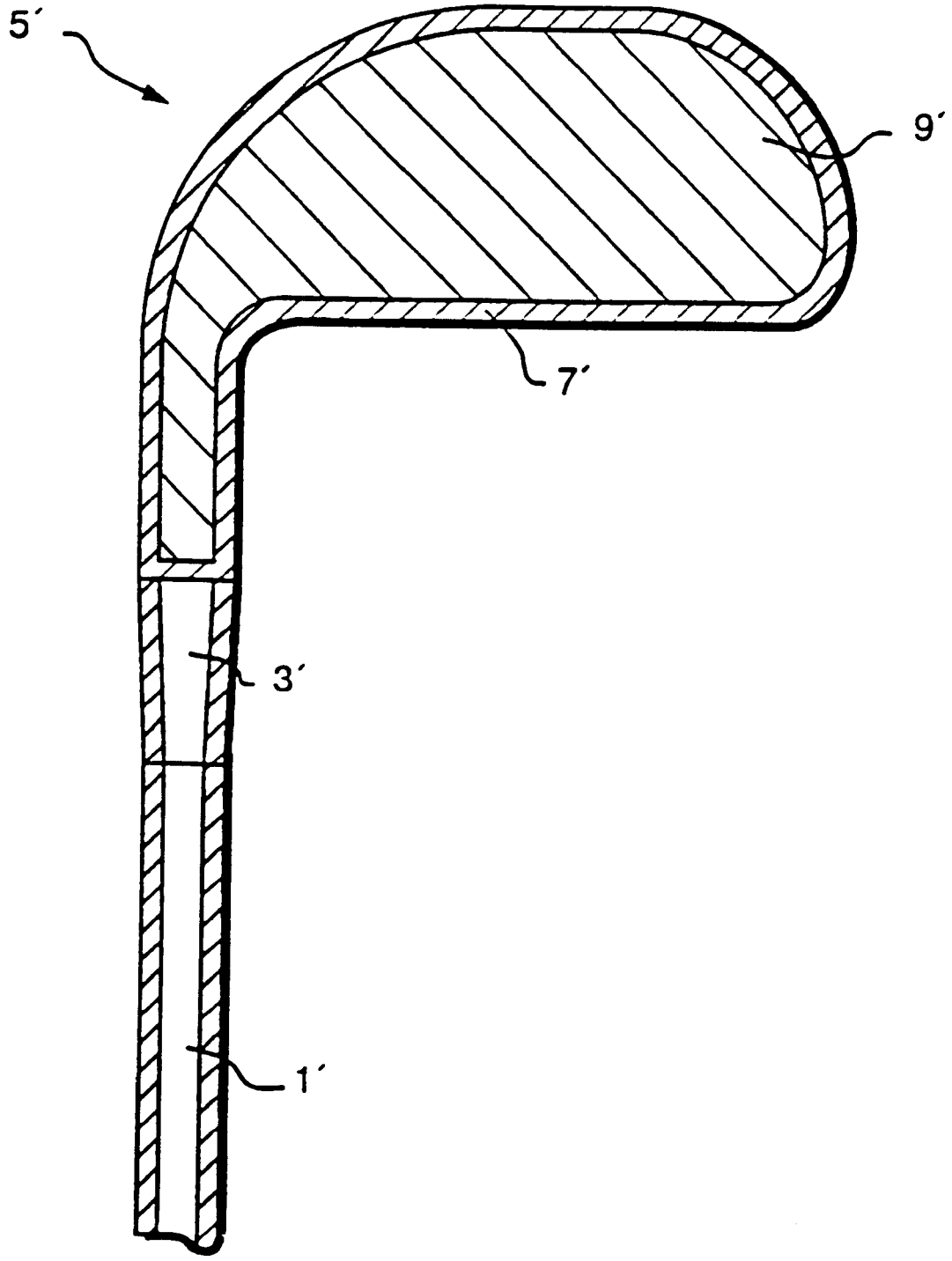
FIG. 4 shows a cut away view of the preferred embodiment of a multilayered golf club head according to the present invention.

The golf club head 5' of the present invention, as shown in FIG. 4, contains an inner soft nickel alloy core 9' and a super hard chrome coating 7'. As stated, core 9' is composed of a soft nickel alloy, the preferred components of which are set forth in table 1, with a HRB rating of from about 70 to about 100 and preferably about 80. In a preferred embodiment, the nickel alloy comprises 0.05% by weight, carbon; 0.48%, by weight, silicon; 1.12%, by weight, manganese; 0.045%, by weight, tungsten; 0.02%, by weight, phosphorous; 0.003%, by weight, sulfur; 8.24%, by weight, nickel; 0.006%, by weight, tin; 18.31%, by weight, Chromium; 70–71%, by weight, iron; 0.1–0.2%, by weight, copper; 0.044%, by weight, nitrogen; 0.018%, by weight, niobium; 0.016%, by weight, titanium and 0.045%, by weight, vanadium.

TABLE 1

| Percentile Weight Specification Fe—Cr/Ni | | | |
|---|---|---|---|
| C | Si | Mn | W |
| 0.0–1.0 | 0.0–1.50 | 0.0–2.50 | 0.0–1.0 |
| P | S | Ni | Sn |
| 0.0–1.2 | 0.0–1.0 | 1.0–30.0 | 0.0–0.5 |
| Cr | Fe | Cu | N |
| 5.0–25.0 | 50–90 | 0.0–1.2 | 0.0–1.5 |
| Nb | TI | V | |
| 0.0–1.18 | 0.0–1.16 | 0.0–1.45 | |

Figure 1:
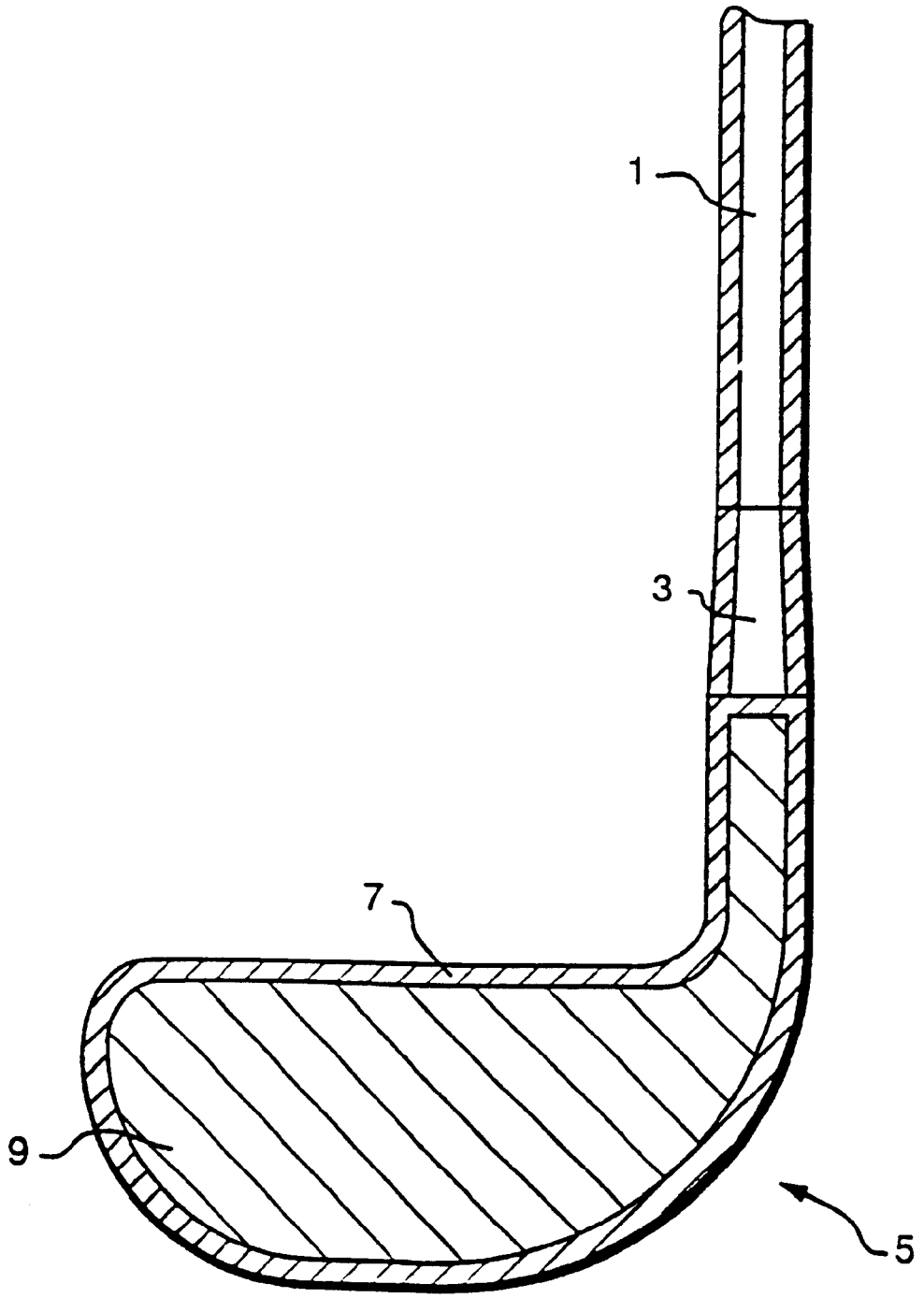
FIG. 1 (PRIOR ART)
FIG. 1 shows a cut away view of a prior art iron golf club head.

The chrome coating 7' is a standard industrial chromium or chrome metal that has a hardness of 9.0 on Moh's scale and an electrical resistivity of 2.6 micro-ohms per $cm^3$. The chrome or chromium metal's HRB rating is approximately 72. As shown by comparing FIG. 1 with FIG. 4, the prior art golf club head 5 and the golf club head according to the present invention 5' are identical in all aspects except the golf club head according to the present invention 5' has an inner core 9' of nickel alloy and an outer chrome coating 7'.

In contrast to the prior art golf clubs described above, the chrome outer layer used in the invention is applied in a layer from about 800 millionths of an inch (0.0008") to about 1000 millionths of an inch (0.001") which is at least four times thicker than conventional applications of decorative chrome in prior art clubs. Preferably, 0.001" is used. The hard chrome used provides durability without compromising the superior feel characteristics of using the relatively soft nickel alloy core when a golf ball is struck. To the extent that the hard chrome layer 7' is damaged such that the inner core 9' is exposed, the nickel alloy is less susceptible to oxidation in comparison to standard mild carbon steel cores.

Figure 2:
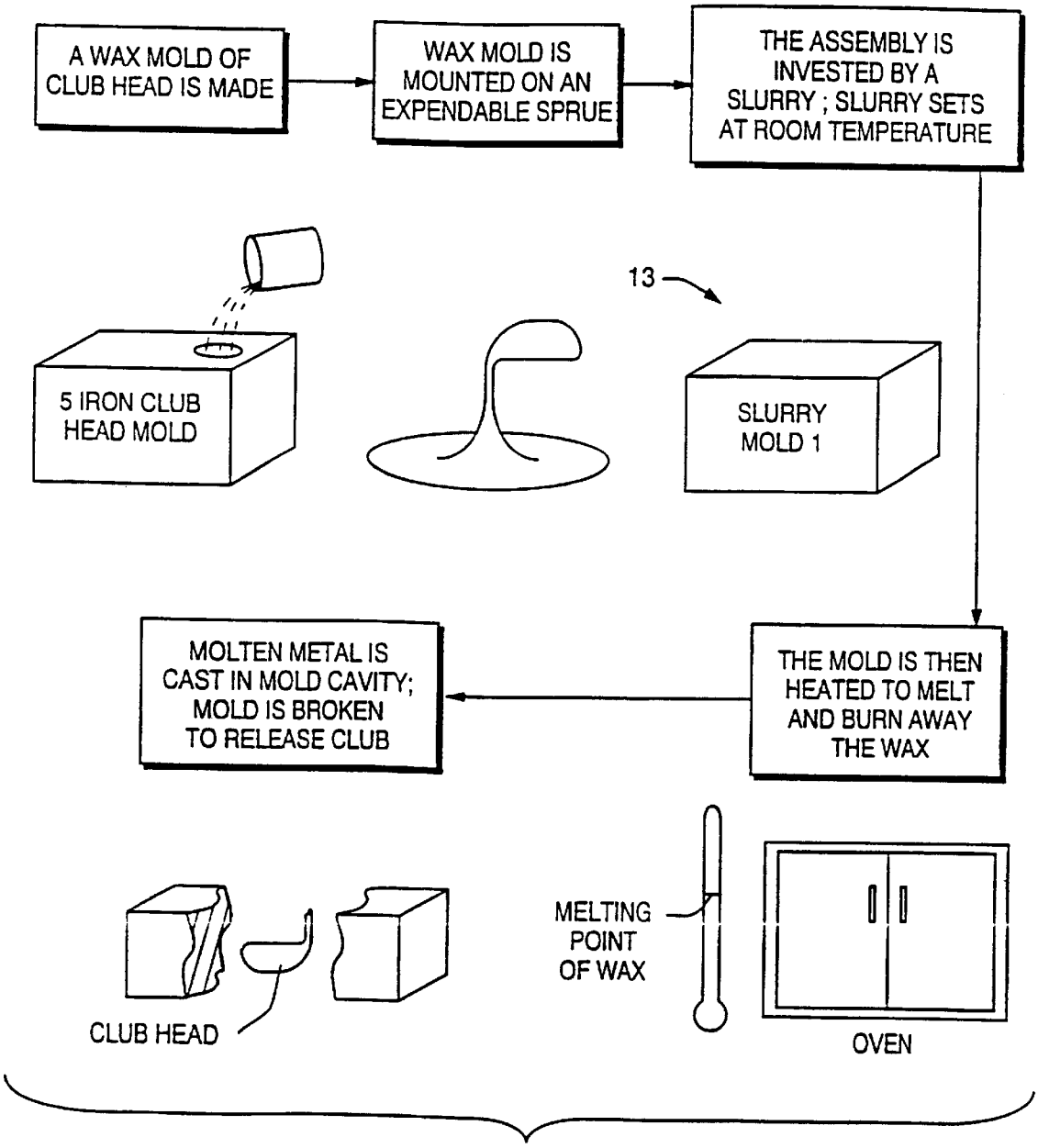
FIG. 2 is a schematic view of the investment casting process.

To produce a golf club head according to the present invention, a known method of forming a shaped object from metal, investment casting, is utilized as shown in FIG. 2. In investment casting, patterns of wax or other expendable material are mounted on expendable sprues, and the assembly is invested, or surrounded by a refractory slurry which sets and hardens at room temperature. The mold is then heated to 900° C. to melt and burn out the wax or other expendable material, following which molten metal is cast into the mold cavity. The molten metal is allowed to cool for approximately one hour. This casting process is particularly adapted to the production of small intricate parts using metals of higher melting points than are feasible for other forms of casting.

Figure 3:
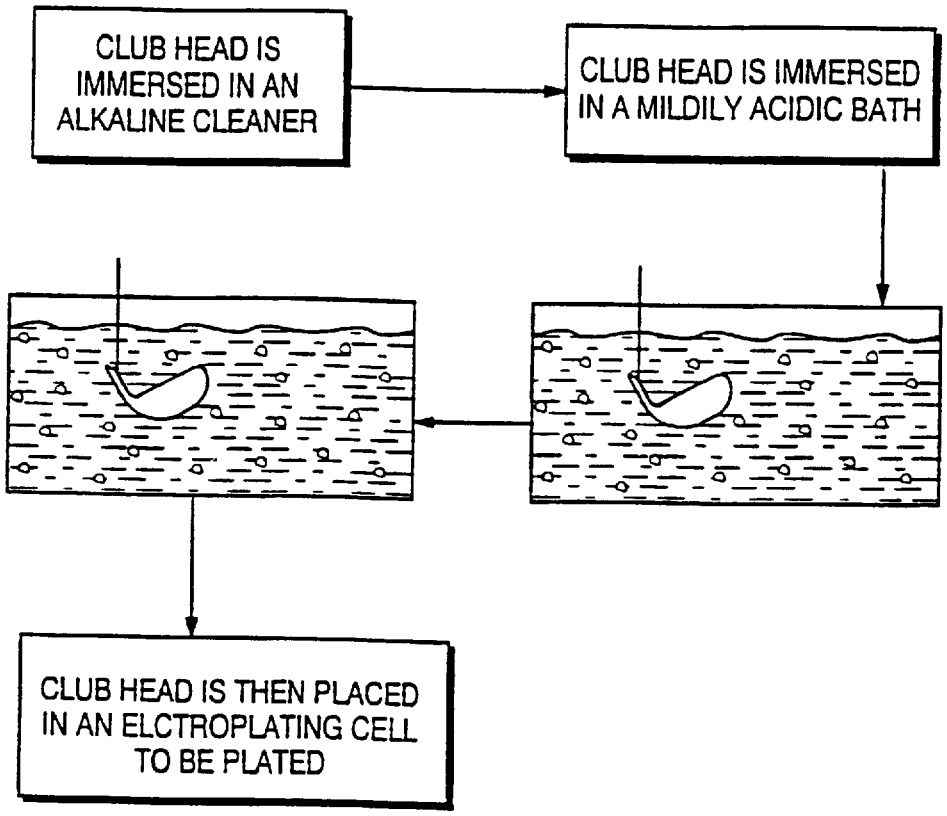
FIG. 3 is a schematic view of the electroplating process.
Figure 3:
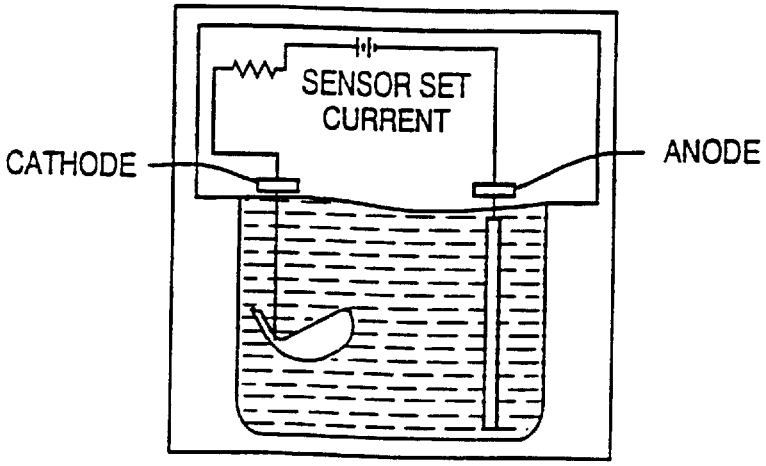

To make a golf club head according to the present invention, a nickel alloy having a similar or the same composition set forth in table 1 is melted and poured into a mold 13 which is prepared in accordance with the investment casting process described above. The melted nickel is then hardened at room temperature for approximately one hour and removed from the mold 13. The resulting golf club heads are then finished according to standard finishing processes such as grinding and shaping to the desired size, shape and smoothness. The outer coating 7' of chrome is subsequently electroplated onto core 9' by immersion into an electrolyte bath, as shown in FIG. 3.

Prior to electroplating, however, the soft nickel alloy core 9' is immersed in an alkaline cleaner to remove dirt oil, grease and any natural oxides. Core 9' is then immersed in a mildly acidic bath to neutralize any traces of the alkaline cleaner. Core 9' is then placed in the electroplating cell to be plated.

As is well known in the art, electroplating is the process by which a metal is deposited on the surface of an object which is placed in an electroplating cell. Specifically, an electroplating cell contains a type of salt solution of the plating metal. Thus, a chromium or chrome plating cell contains a solution of a soluble chrome salt, i.e. a chrome ion, and an anode of chromium metal. The object to be plated, i.e. the soft nickel alloy core 9', is the cathode. The chrome anode is attached to the positive electrode of a battery or some other type of direct current. Core 9' is connected to the negative electrode. Thus, according to the present invention, the soft nickel alloy core 9' serves as the cathode onto which chrome is plated. Then, as this process takes place, the chrome ions are reduced at the cathode of the cell when electrons flow through the circuit. The chrome ions are oxidized at the anode, removed from the solution at the cathode and deposited as metallic chrome on Core 9'.

The end result is that the chrome is transferred from the anode to the core 9' to form an outer chrome coating 7'. The electroplating is continued until a coating 7' of 0.0008 inches is achieved, although the coating can be as much as 0.001 inches. The club head 5' is then assembled into a golf club by being affixed to a golf club shaft which has a golf club grip attached to the end opposite the golf club head. The methods used to assemble a golf club are well known in the art.

As this invention may be embodied in several forms without departing from the spirit of the invention thereof, the present embodiments are therefore illustrative and not restrictive, since the scope of the invention is defined by the appended claims rather than by the description preceding them, and all changes that fall within the meets and bounds of the claims or the equivalent thereof are therefore intended to be embraced by the claims.

Having thus described my invention, what I claim as new and desire to secure by United States Letters Patent is:

1. A golf club head comprising:

a core formed from a nickel alloy having a hardness Rockwell B-scale rating of from about 70 to about 100 and wherein the nickel alloy has from about 1% to about 30% by weight, nickel; and, an outer hard chrome coating having a hardness Rockwell C-scale of from about 50 to about 75 which is plated onto the core.

2. The golf club head of claim 1 wherein the nickel alloy has an HRB rating of about 80.

3. The golf club head of claim 1 wherein the nickel alloy has from about 50% to about 90% by weight, iron.

4. The golf club head of claim 1 wherein the chrome coating has an electrical resistivity of about 2.6 micro-ohms per $cm^3$.

5. The golf club head of claim 1 wherein the chrome coating has a thickness of from about 0.0008" to about 0.001".

6. A golf club comprising:

a golf club head comprising:

(a) a core comprised of a nickel alloy wherein nickel alloy has a hardness Rockwell B-scale rating of from about 70 to about 100 and (b) an outer hard chrome coating; and, a shaft attached to the head.

7. The golf club of claim 6 further comprising a grip attached to an end of the shaft distal from the attachment point of the golf club head to the shaft.

8. The golf club of claim 6 wherein the nickel alloy has an HRB rating of about 80.

9. The golf club of claim 6 wherein the nickel alloy has from about 1% to about 30%, by weight, nickel.

10. The golf club of claim 9 wherein the nickel alloy has from about 50% to about 90%, by weight, iron.

11. The golf club of claim 6 wherein the chrome coating has a hardness Rockwell C-scale rating of from about 50 to about 75.

12. The golf club of claim 6 wherein the chrome coating has an electrical resistivity of about 2.6 micro-ohms per $cm^3$.

13. The golf club of claim 6 wherein the chrome coatings a thickness of from about 0.0008" to about 0.001".

14. A method of making a golf club head comprising the steps of:

providing a nickel alloy wherein the alloy has from about 1% to about 30% by weight nickel and wherein the nickel alloy has a hardness Rockwell B-scale rating of from about 70 to about 100 investment casting the nickel alloy into the shape of a golf club head core; and electroplating said head core with a hard chrome coating wherein the chrome coating has a hardness Rockwell C-scale rating of from about 50 to about 75.

15. The method as claimed in claim 14 wherein the hard outer layer of chrome is electroplated until it achieves a thickness of from about 0.0008 inch to about 0.001 inch.

16. The method of claim 14 comprising the further steps of:

pouring the nickel alloy into a mold in which the nickel alloy is allowed to harden at room temperature;

removing a molded club head core from the mold; and, grinding the molded club head core into a final shape, size and smoothness.

17. The method of claim 16 comprising the further steps of:

immersing the molded club head into an alkaline cleaner in which dirt, oil, grease and natural oxides are removed to produce a cleaned molded club head; and, immersing the cleaned molded club head into an acidic bath prior to the step of electroplating the hard outer chrome coating onto the cleaned molded club head.

18. The method of claim 17 wherein the hard outer chrome coating is electroplated onto the cleaned molded club head until the thickness of the chrome coating reaches from about 0.0008 inch to about 0.001 inch.

19. The method of claim 14 comprising the further steps of:

attaching the golf club head to an end of a golf club shaft; and, attaching a golf club grip to an opposite end of the golf club shaft to form a golf club.

20. A golf club head comprising:

a core formed from a nickel alloy wherein the alloy has from about 1% to about 30% by weight nickel and wherein the nickel alloy core has a hardness Rockwell B-scale rating of from about 70 to about 100; and, an outer hard chrome coating wherein the chrome coating has a thickness of from about 0.0008" to about 0.0001" and wherein the chrome coating has a hardness Rockwell C-scale rating of from about 50 to about 75.

21. The golf club head of claim 20 wherein the nickel alloy comprises about 0.00% to about 1.0%, by weight, carbon; about 0.0% to about 1.0%, by weight, silicon; about 0.0% to about 2%, by weight, manganese; about 0.0% to about 1.0%, by weight, tungsten; about 0.0% to about 1.0%, by weight, phosphorus; about 0.0% to about 1.0%, by weight, sulfur; about 1.0% to about 30.0%, by weight, nickel; about 0.0% to about 1.0%, by weight, tin; about 5.0% to about 25.0%, by weight, chromium; about 50% to about 90%, by weight, iron; about 0.0% to about 1.0%, by weight, copper; about 0.0% to about 1.0%, by weight, nitrogen; about 0.0% to about 1.0%, by weight, niobium; about 0.0% to about 1.0%, by weight, titanium; about 0.0% to about 1.0%, by weight, vanadium.

22. The golf club head of claim 20 wherein the nickel alloy comprises 0.05%, by weight, carbon; 0.48%, by weight, silicon; 1.12%, by weight, manganese; 0.045%, by weight, tungsten; 0.02%, by weight, phosphorous; 0.003%, by weight, sulfur; 8.24%, by weight, nickel; 0.006%, by weight, tin; 18.31%, by weight, chromium; 70–71%, by weight, iron; 0.1–0.2%, by weight, copper; 0.044%, by weight, nitrogen; 0.018%, by weight, niobium; 0.016%, by weight, titanium and 0.045%, by weight, vanadium.

23. A golf club comprising:

a golf club head comprising:

a core formed from a nickel alloy wherein the alloy has from about 1% to about 30% by weight nickel and wherein the nickel alloy core has a hardness Rockwell B-scale rating of from about 70 to about 100; and, an outer hard chrome coating wherein the chrome coating has a thickness of from about 0.0008" to about 0.0001" and wherein the chrome coating has an hardness Rockwell C-scale rating of from about 50 to about 75; and, a golf club shaft attached to the golf club head.

24. The golf club of claim 23 further comprising a grip attached to an end of the shaft distal from the attachment point of the golf club head to the shaft.

25. The golf club of claim 23 wherein the nickel alloy comprises about 0.00% to about 1.0%, by weight, carbon; about 0.0% to about 1.0%, by weight, silicon; about 0.0% to about 2%, by weight, manganese; about 0.0% to about 1.0%, by weight, tungsten; about 0.0% to about 1.0%, by weight, phosphorus; about 0.0% to about 1.0%, by weight, sulfur; about 1.0% to about 30.0%, by weight, nickel; about 0.0% to about 1.0%, by weight, tin; about 5.0% to about 25.0%, by weight, chromium; about 50% to about 90%, by weight, iron; about 0.0% to about 1.0%, by weight, copper; about 0.0% to about 1.0%, by weight, nitrogen; about 0.0% to about 1.0%, by weight, niobium; about 0.0% to about 1.0%, by weight, titanium; about 0.0% to about 1.0%, by weight, vanadium.

26. The golf club of claim 23 wherein the nickel alloy comprises 0.05%, by weight, carbon; 0.48%, by weight, silicon; 1.12%, by weight, manganese; 0.045%, by weight, tungsten; 0.02%, by weight, phosphorous; 0.003%, by weight, sulfur; 8.24%, by weight, nickel; 0.006%, by weight, tin; 18.31%, by weight, chromium; 70–71% 71%, by weight, iron; 0.1–0.2%, by weight, copper; 0.044%, by weight, nitrogen; 0.018%, by weight, niobium; 0.016%, by weight, titanium and 0.045%, by weight, vanadium.

* * * * *